US005106813A

United States Patent [19]

Hoshino et al.

[11] Patent Number: 5,106,813

[45] Date of Patent: Apr. 21, 1992

[54] THERMOSENSITIVE RECORDING MATERIAL

[75] Inventors: Futoshi Hoshino, Tokyo; Makoto Nakano, Chigasaki; Kousuke Someya; Junko Morita, both of Yokohama; Takeshi Yanagihara, Chigasaki, all of Japan

[73] Assignee: Mitsui Toatsu Chemicals, Incorporated, Tokyo, Japan

[21] Appl. No.: 500,303

[22] Filed: Mar. 28, 1990

[30] Foreign Application Priority Data

Oct. 27, 1989 [JP] Japan ..... 1-278621

[51] Int. Cl.[5] ..... B41M 5/40

[52] U.S. Cl. ..... 503/207; 427/152; 503/200; 503/217; 503/226

[58] Field of Search ..... 427/152; 503/200, 207, 503/226, 217

[56] References Cited

FOREIGN PATENT DOCUMENTS 0291315 11/1988 European Pat. Off. ..... 503/226
0304936 3/1989 European Pat. Off. ..... 503/226
2179170 2/1987 United Kingdom .

OTHER PUBLICATIONS

Patent Abstracts of Japan, vol. 4, No. 128, Sep. 9, 1980 (JP 55/86789).

Patent Abstracts of Japan, vol. 12, No. 152, May 11, 1988 (JP 62/273883).

*Primary Examiner*—Bruce H. Hess

*Attorney, Agent, or Firm*—Millen, White & Zelano

[57] ABSTRACT

A thermosensitive recording paper is disclosed useful for thermosensitive recording which comprises a substrate, a thermosensitive recording layer and an undercoat layer interposed therebetween which contains 10 to 40 parts of a binder and 60 to 90 parts by weight of crosslinked polymer microparticles having a particle diameter of 0.2 to 5.0 μm and a ratio of weight average diameter to number average diameter of 2.0 or less.

12 Claims, No Drawings

THERMOSENSITIVE RECORDING MATERIAL

BACKGROUND OF THE INVENTION (a) Field of the Invention

The present invention relates to a thermosensitive recording material suitable for use in information devices such as facsimiles, printers, data communication parts and computer terminals.

More specifically, the present invention relates to a thermosensitive recording material having excellent color development sensitivity which meets the high speed requirements of information devices such as facsimiles.

(b) Description of the Related Art

A thermosensitive recording material can be obtained, for example, by dispersing a colorless or light-color leuco dye as a color former and a phenolic compound such as bisphenol A as a developer in a binder, then coating a substrate such as a paper with the resulting dispersion and drying the same.

The thus obtained thermosensitive recording material develops a color with the aid of heat from a heating head or exothermic pen, whereby an image record can be easily obtained. For this reason, the thermosensitive recording material is used in many fields such as information devices such as facsimiles, thermal printers, data communication parts and computer terminals as well as labels, tickets and passes.

Particularly, the temperature of the thermal head on the exothermic pen of such devices becomes lowered along with the increased speed and miniaturization of such information devices. Accordingly, it is desired that the thermosensitive recording material to be used therein has a high color development sensitivity.

One process for increasing the speed of the color development is to raise the temperature of the thermal head. However, when the temperature of the thermal head is elevated, problems such as the adhesion of dregs and sticking tend to occur and the life of the thermal head is also shortened. Thus, the above-mentioned process is not practical.

Japanese Laid-open Patent Publication No. 59-143683 discloses a technique in which crosslinked styrene microparticles are present in a color development layer in order to prevent the adhesion of dregs, sticking and pressure color development by scratching. However, this technique is not practical because sharp images having a high density cannot be obtained thereby.

Another technique has also been suggested in which a heat insulating intermediate layer containing thermoplastic hollow fine grains is interposed between a substrate and a thermosensitive color development layer so as to effectively apply the heat of the thermal head to the thermosensitive color development layer, whereby sharp images having a high density can be obtained (Japanese Patent Laid-open Publication Nos. 62-117787 and 63-21180). In this process, however, the fine grains themselves are melted by the heat, so that the adhesion of dregs on the thermal head and sticking take place noticeably, which means that the above-mentioned technique is not practical.

OBJECT AND SUMMARY OF THE INVENTION

An object of the present invention is to provide a high-sensitivity thermosensitive recording material which can be used without any sticking and without any dregs adhesion and which is useful in the field of thermosensitive recording.

Another object of the present invention is to provide a thermosensitive recording material having excellent printability which can be used in high speed equipment without sticking and without dregs adhesion and by which high print density can be obtained.

The objects of the present invention can be achieved by providing a thermosensitive recording material having a thermosensitive recording layer containing a color former and a developer for developing a color upon contact with the color former in which an undercoat layer is interposed between a substrate and the thermosensitive recording layer, the aforesaid undercoat layer containing 10 to 40 parts of a binder and 60 to 90 parts by weight of polymer microparticles having a particle diameter of 0.2 to 5.0 μm and a Dw/Dn particle diameter distribution of 2.0 or less, wherein Dw is the weight average particle diameter and Dn is the number average particle diameter.

DETAILED DESCRIPTION OF THE INVENTION

The present inventors first conceived that when an intermediate layer, i.e., an undercoat layer for a thermosensitive recording layer is interposed between a substrate and the thermosensitive recording layer and when heat insulating properties and thermally molten material-absorbing properties are introduced into the undercoat layer, the resultant recording material is provided with practical high-speed recording properties which include excellent color development sensitivity by which dregs adhesion and sticking can be prevented.

In order to achieve this objective, the inventors have devised a means of making the undercoat layer porous, and they have conducted intensive research, paying much attention to the effect of spaces among particles formed at the time when a large amount of heat-resistant polymer microparticles are added to the undercoat layer.

As a result, the inventor have found that the thus constituted undercoat can prevent the dregs adhesion onto the thermal head and the sticking and improve the color development sensitivity, and the present invention can be completed on the basis of this knowledge.

The present invention is a thermosensitive recording material having a thermosensitive recording layer containing a substrate, a color former and a developer for developing a color at the time of the contact with the color former, in which an undercoat layer containing a large amount of polymer microparticles having a crosslinked structure is interposed between the substrate and the thermosensitive recording layer.

The polymer fine particles having the crosslinked structure used in the present invention preferably is prepared by subjecting a monomer mixture containing a crosslinkable monomer to an emulsion polymerization which produces polymer microparticles having a particle diameter in the range of from 0.2 to 5.0 μm.

Conventional crosslinkable monomers can be used in the present invention, e.g., monomers having two or more polymerizable unsaturated bonds in one molecule, such as divinylbenzene, ethylene glycol di(meth)acrylate and trimethylolpropane trimethacrylate.

The crosslinkable monomer is used in an amount of 0.5 to 10% by weight, preferably 1.5 to 7% by weight based on the weight of the monomer mixture containing an undermentioned vinyl monomer. When the amount of the crosslinkable monomer is less than 0.5% by weight, the crosslinking density of the resulting particles is low and sufficient heat-resistant properties cannot be obtained. Conversely, when it is more than 10% by weight, the formation of an aggregate tends to occur, so that polymerization itself does not proceed smoothly.

Examples of suitable vinyl monomers include aromatic vinyl compounds such as styrene, α-methylstyrene and vinyltoluene, acrylates, such as methyl (meth-)acrylate, ethyl (meth)acrylate and butyl (meth)-acrylate, vinyl esters such as vinyl acetate and vinyl propionate, a vinylcyan compound such as (meth)acrylonitrile, and halogenated vinyl compounds such as vinyl chloride and vinylidene chloride. However, from the viewpoint of the heat resistance of the resulting particles, it is preferred that styrene or methyl methacrylate is used to produce the main component of the particles.

For the purpose of adding stability to an emulsion, a functional monomer (functional group-containing vinyl monomer) can be used together with the above-mentioned vinyl monomer. Examples of such functional monomers include unsaturated carboxylic acids such as (meth)acrylic acid, crotonic acid and itaconic acid, unsaturated sulfonates such as sodium styrene sulfonate, (meth)acrylates such as 2-hydroxyethyl (meth)acrylate and glycidyl (meth)acrylate, (meth)acrylamide and N-methylol (meth)acrylamide.

The amount of the functional monomer employed usually is in the range of 20% by weight or less, preferably 10% by weight or less based on the weight of the vinyl monomer. When the amount of the functional monomer is more than 20% by weight, secondary particles are produced and a particle diameter distribution thereof expands, so that spaces among the particles in the herein described undercoat layer decrease, with the result that the object of the present invention cannot be achieved.

The polymer fine particles having a crosslinked structure preferably are prepared by subjecting the mixture of the above-mentioned monomers to emulsion polymerization.

Examples of a surface active agent which can be used in the present invention to form the emulsion include anionic surface active agents such as sodium alkylbenzene sulfonate, sodium alkylsulfate, sodium dialkyl sulfosuccinate and naphthalenesulfonic acid-formaldehyde condensate, and nonionic surface active agents such as polyoxyethylene alkyl ether, polyoxyethylene alkyl phenol ether, ethylene oxide-propylene oxide block copolymer and sorbitan fatty acid ester. These surface active agents can be used singly or in combination.

Anionic surface active agents are preferred, because this type of surface active agent does not impede the color development in the color development layer. Nonionic surface active agents are also acceptable, in small amounts.

The amount of the surface active agent employed is not critical, but usually it is in the range of about 0.1 to about 10% by weight based on the weight of the total monomers.

Any polymerization initiator conventionally used in emulsion polymerizations can be utilized in the present invention. Examples of such a polymerization initiator include persulfates such as potassium persulfate, sodium persulfate and ammonium persulfate, an organic peroxide such as benzoylhydroperoxide, and an azo compound such as azobisisobutylonitrile. If necessary, the polymerization initiator can be used in the form of a redox initiator in combination with a reducing agent.

The polymerization can be carried out at a temperature of from 20° to 90° C. under nitrogen purging, while the monomer mixture is added all at once in divided portions or as a continuous stream or dropwise.

The thus obtained polymer microparticles have a crosslinked structure and a particle diameter of 0.2 to 5.0 μm, preferably 0.3 to 3.0 μm. When the particle diameter is less than 0.2 μm, the spaces among the particles in the undercoat layer decrease, so that the high-sensitive thermosensitive recording material of the present invention cannot be obtained and, in addition, the effect of preventing sticking and dregs adhesion is also insufficient. On the other hand, when the particle diameter is more than 5.0 μm, the spaces among the particles in the undercoat layer excessively increase, so that the thermosensitive color development component penetrates into the undercoat layer and the content of this component in the thermosensitive recording layer is reduced, with the result that a color development sensitivity decreases undesirably.

The particles employed in the present invention have a narrow diameter distribution. To achieve a narrow diameter distribution, the so-called seed emulsion polymerization is preferable, i.e., the polymerization is divided into two steps and, in the first step, a seed particle emulsion is formed in the presence of the above-mentioned surface active agent and polymerization initiator and, in the second step, the monomer mixture containing the above-mentioned cross-linkable monomer is then added. When this process is repeated, the larger particles which are unobtainable by the one-stage polymerization can easily be prepared.

Thus, the microparticles employed in this invention have a Dw/Dn ratio which is an indication of the particle diameter distribution, is 2.0 or less, preferably 1.5 or less, the aforesaid ratio being calculated from the following weight average particle diameter Dw and number average particle diameter Dn:

$$Dw = \Sigma fi \cdot Di^4 / \Sigma fi \cdot Di^3$$

$$Dn = \Sigma fi \cdot Di / \Sigma fi$$

wherein fi is the number of the particles having a particle diameter of Di.

When the Dw/Dn ratio is more than 2.0, the particle diameter distribution increases excessively, so that the spaces between the particles, which should be arranged regularly by these particles themselves are disordered. As a consequence, the spaces between the particles decrease in size, which means that the thermosensitive recording material of the present invention intends cannot be obtained. In this connection, the above-mentioned particle diameter can easily be measured from an electron micrograph.

The thermosensitive recording material of the present invention, in which the undercoat layer containing a large amount of the polymer microparticles is interposed between the substrate and the thermosensitive recording layer can be prepared as described hereinafter.

Although a plastic sheet or synthetic paper or the like can be used as the substrate, a conventional cellulosic pulp paper is usually employed.

The undercoat layer can be prepared by first mixing the organic polymer employed as a binder, the polymer microparticles and an inorganic filler, such as calcium carbonate or calcined clay, which can be used for the sake of overall cost reduction, coating the substrate with the resulting mixture, and then drying the same.

The binder can be any adhesive material which increases the adhesive strength of the bond between the substrate and the undercoat layer, e.g., one selected from the group consisting of aqueous polymer dispersions, such as styrene-butadiene latex and acrylic emulsion, aqueous solutions of polyvinyl alcohol, starch and hydroxyethyl cellulose, and mixtures thereof.

The amount of the polymer microparticles having the crosslinked structure in the undercoat layer is about 60 to 90 parts by weight, preferably 70 to 85 parts by weight. When the amount of the polymer fine particles is less than 60 parts by weight, effective spacing of the particles cannot be obtained and, as a result, the color development sensitivity is poor and the effect of preventing sticking and dregs adhesion is also insufficient. Conversely, when the amount thereof is more than 90 parts by weight, the content of the binder becomes too low as a natural consequence, so that the strength of the under coat layer itself and the adhesive strength between the substrate and the under coat layer deteriorates and, as a result, the thus obtained product cannot withstand the use as the thermosensitive recording material.

On the other hand, although the amount of the binder employed depends upon the amounts of the above-mentioned polymer microparticles and the inorganic filler which optionally is used when needed, it is usually from 10 to 40 parts by weight, preferably from 10 to 30 parts by weight, more preferably from 15 to 25 parts by weight. The reason the binder should be in the above-mentioned range is the same as in the case of the aforesaid polymer microparticles.

The amount of the inorganic filler which can be present when desired is 20 parts by weight or less, preferably 10 parts by weight or less. When the amount of the inorganic filler is more than 20 parts by weight, the spaces between the polymer microparticles which are otherwise determined by the particles themselves become disordered, and the effect of a high thermal conductivity of the inorganic filler itself increases, which makes it impossible to form the desired high-sensitive thermosensitive recording material of this invention.

The thickness of the dried undercoat is usually about 5 to 15 μm (about 3 to 30 g/m$^2$) in terms of the dried layer.

A mixture of a color former and a developer are present in the thermosensitive recording layer with which the undercoat layer is coated. Examples of the color former are basic colorless dyes, such as fluoran dyes, triallylmethane dyes and phenothiazine dyes. Examples of the developer are phenolic compounds and aromatic carboxylic acids.

In the thermosensitive recording layer, the developer is usually present in a ratio of 1 to 30 parts by weight per part by weight of the color former. A binder is usually present in a weight ratio of 30 parts per 100 parts of the color former and the developer.

Examples of suitable binders are organic synthetic polymers, employed as an aqueous solution or dispersion thereof, for example, aqueous dispersions such as styrene-butadiene latex and acrylic emulsion, aqueous solutions such as polyvinyl alcohol, starch and hydroxyethyl cellulose, and mixtures thereof.

The color former and the developer present in the thermosensitive recording layer of the present invention are preferably separately wet-ground and then dispersed in water in the presence of a dispersion stabilizer, e.g., in a ball mill or the like.

Preferably after the dispersion of the color former and the developer in the water, the following materials are added to the aqueous vehicle used to form the thermosensitive recording layer: the above-mentioned binder, and when needed, an inorganic pigment such as calcium carbonate, magnesium carbonate, talc or kaolin, an ultraviolet light absorber such as a benzophenone type or a triazole type, a sensitizer such as wax or fatty acid amide, and the like. These materials are mixed and stirred until homogeneous, thereby obtaining a blend for producing the thermosensitive recording layer.

The blend solution for the thermosensitive recording layer is then applied onto the undercoat layer so that a coating thickness may be about 2 to 10 μm (about 1 to 20 g/m$^2$) in terms of the dried layer, followed by drying.

The present invention will now be described in detail in reference to examples and comparative examples, but the scope of the present invention should not be limited to these examples.

In this connection, part(s) and % in the examples and comparative examples mean part(s) by weight and % by weight, respectively.

POLYMERIZATION EXAMPLE 1

In a separable flask equipped with a stirrer, a thermometer and a reflux condenser were placed 250 parts of water and 0.01 part of sodium lauryl sulfate and the temperature of the mixture was then raised up to 70° C. with stirring, while the atmosphere in the flask was replaced with nitrogen.

The temperature of the mixture was maintained at 70° C., and 2 parts of potassium persulfate was then added thereto. After dissolution, a monomer mixture of 2 parts of styrene, 0.02 part of acrylic acid and 0.01 part of divinylbenzene were added thereto, and reaction was then effected for 3 hours.

After completion of the reaction, a monomer emulsion which had been previously prepared by mixing 200 parts of water, 1.5 parts of sodium lauryl sulfate, 300 parts of styrene, 3 parts of acrylic acid and 12 parts of divinylbenzene was added to the above-mentioned solution continuously over 4 hours in order to carry out reaction. After completion of the addition, aging was continued for 4 hours.

The nonvolatile content of the thus obtained emulsion was about 41%, its viscosity was 10 cps (BM type viscometer Rotor No. 1, number of revolutions 60 rpm and temperature 25° C.), its pH was 2.1 and, as measured by an electron microscope, the weight average particle diameter (Dw) was 0.65 μm and the Dw/Dn ratio was 1.02.

POLYMERIZATION EXAMPLES 2 TO 7

Polymerization was carried out following the same procedure as in Polymerization Example 1, except that amounts of the surface active agent which was first added and the monomer mixture and the composition of the monomers were changed as set forth in Table 1, to obtain polymer microparticles having a crosslinked structure as products of Polymerization Examples 2 to 5.

Furthermore, in Polymerization Examples 6 and 7, seed emulsion polymerization was carried out in the presence of the emulsion particles obtained in Polymerization Examples 1 and 5, respectively, thereby producing polymer microparticles having a crosslinked structure as products.

POLYMERIZATION EXAMPLE 8

The same polymerization procedure as in Polymerization Example 1 was repeated except that no divinylbenzene was added, in order to prepare polymer microparticles which did not have a crosslinked structure.

The obtained fine particles had a particle diameter of 0.6 μm, and from the results of differential thermal analysis, it was confirmed that they were thermoplastic particles having a glass transition temperature of 103° C.

POLYMERIZATION EXAMPLES 9 AND 10

In Polymerization Example 9, amounts of acrylic acid and a surface active agent were increased in the first polymerization step so as to form small-sized particles. In Polymerization Example 10, the amount of the surface active agent was increased in the second polymerization step so as to expand the particle diameter distribution. The results are set forth in Table 1.

TABLE 1

| Material | Polymerization Example 1 | 2 | 3 | 4 | 5 | 6* | 7* | 8 | 9 | 10 |
|---|---|---|---|---|---|---|---|---|---|---|
| Reaction in First Step | | | | | | | | | | |
| ST | 2.0 | 6.0 | 1.0 | | | | | 2.0 | | 1.0 |
| MMA | | | | 2.0 | 1.0 | | | | 6.0 | |
| BMA | | | | | | — | — | | | |
| AAc | 0.02 | 0.06 | | 0.01 | 0.01 | | | 0.02 | 0.12 | |
| DVB | 0.01 | 0.03 | | 0.01 | 0.005 | | | | | |
| NaLS | 0.01 | 0.06 | 0.005 | 1.2 | 0.005 | | | 0.01 | 0.30 | 0.005 |
| Reaction in Second Step | | | | | | | | | | |
| ST | 300.0 | 260.0 | 320.0 | | | 300.0 | | 300.0 | | 320.0 |
| MMA | | | | 300.0 | 280.0 | | 280.0 | | 300.0 | |
| AN | | 30.0 | | | 20.0 | | 20.0 | | | |
| BMA | | 10.0 | | | | | | | | |
| AAc | 3.0 | 3.0 | 3.0 | 2.0 | 3.0 | 3.0 | 3.0 | 3.0 | 3.0 | 3.0 |
| AAm | | | | 1.0 | 2.0 | | 2.0 | | | 3.0 |
| DVB | 12.0 | 15.0 | 12.0 | 12.0 | 6.0 | 12.0 | 6.0 | | 10.0 | |
| NaLS | 1.5 | 1.5 | 1.6 | 1.5 | 1.5 | 1.5 | 1.5 | 1.5 | 3.0 | 16.0 |
| Nonvolatile Content (%) | 41.2 | 42.0 | 41.9 | 41.6 | 41.2 | 34.0 | 24.3 | 40.8 | 41.5 | 42.8 |
| Particle Diameter (μm) | 0.65 | 0.32 | 1.06 | 0.58 | 0.97 | 2.01 | 3.11 | 0.60 | 0.12 | 0.83 |
| Dw/Dn | 1.02 | 1.01 | 1.04 | 1.01 | 1.05 | 1.19 | 1.43 | 1.03 | 1.00 | 2.13 |
| Tg (°C.) | none | none | none | none | none | none | none | 104 | none | 106 |

ST; styrene, MMA; methyl methacrylate, BMA; butyl methacrylate, AN; acrylonitrile AAc; acrylic acid, AAm; acrylamide, DVB; divinylbenzene, NaLS; sodium lauryl sulfate

*Polymerization Example 6: The monomer mixture of Example 1 was polymerized under conditions of 25.5 g of the emulsion prepared in Polymerization Example 1, 400 g of water and 2 g of ammonium persulfate.

*Polymerization Example 7: The monomer mixture of Example 5 was polymerized under conditions of 25.2 g of the emulsion prepared in Polymerization Example 5, 750 g of water and 2 g of ammonium persulfate.

EXAMPLE 1 i) Preparation of an undercoat blend

The emulsion obtained in Polymerization Example 1 was mixed to uniformity with a mixture of components and in the ratio shown in Table 2 to prepare an undercoat blend for a thermosensitive recording material of this invention.

ii) Preparation of a thermosensitive recording layer blend

A solution A (color former dispersion) and a solution B (developer dispersion) each comprising the following components were prepared by mixing the components in a sand mill.

| | |
|---|---|
| Solution A: | |
| 3-dimethylamino-6-methyl-7-anilinofluoran | 20 pts. wt. |
| 20% aqueous hydroxyethyl cellulose solution | 5 pts. wt. |
| water | 75 pts. wt. |
| Solution B: | |
| bisphenol A | 20 pts. wt. |
| 20% aqueous hydroxyethyl cellulose solution | 5 pts. wt. |
| Petrolight #R-50 (made by Macrocrystalline Wax Halico Co., Ltd.) | 5 pts. wt. |
| water | 70 pts. wt. |

After mixing to uniformity in the sand mill, 15 parts by weight of the solution A, 40 parts by weight of the solution B, 20 parts of calcium carbonate and 25 parts by weight of a 20% aqueous polyvinyl alcohol solution (#K-117; made by Kuraray Co., Ltd.) were mixed sufficiently to obtain a blend for a thermosensitive recording layer.

A commercial cellulosic pulp paper (unit weight about 50 g/m$^2$) was coated with the above-mentioned undercoat blend by a bar coater in an amount which provided a dried coating weight of 15 g/m$^2$, followed by drying.

Next, the thermosensitive recording layer blend was applied onto the resulting undercoat layer by the bar coater in an amount which provided a coating weight of 15 g/m$^2$, whereby a thermosensitive recording material of this invention was obtained.

Printing and color development were carried out by the use of a thermosensitive paper printing device (TH-PMD made by Ohkura Electric Co., Ltd.) under the following conditions:

applied voltage 24 V, pulse width 1.74 ms and applied energy 0.34 mJ/dot.

The density of the color was measured by using a Macbeth densitometer.

Printing suitability was evaluated by developing a color under the following conditions, and inspecting sticking and dregs adhesion on a thermal head:

applied voltage 27 V,
pulse width 3.0 ms and
applied energy 0.73 mJ/dot.

The evaluation was ranked in accordance with the following symbols:

◎: very good (no dregs adhesion)
○: good (dregs adhesion was scarcely seen)
Δ: average (dregs adhesion was slight)
X: bad (dregs adhesion was seen)
XX: very bad (dregs adhesion was noticeable).

TABLE 2

| | Microparticles (pts. wt.) | Binder (pts. wt.) | Inorganic Filler (pts. wt.) | Print Density | Printing Suitability |
|---|---|---|---|---|---|
| Example 1 | Polymerization Example 1 (80) | PVA (20) | | 1.32 | ◎ |
| Example 2 | Polymerization Example 2 (80) | PVA (20) | | 1.29 | ○ |
| Example 3 | Polymerization Example 3 (80) | PVA (20) | | 1.35 | ◎ |
| Example 4 | Polymerization Example 4 (80) | PVA (20) | | 1.31 | ○ |
| Example 5 | Polymerization Example 5 (80) | PVA (20) | | 1.35 | ○ |
| Example 6 | Polymerization Example 6 (80) | PVA (20) | | 1.37 | ◎ |
| Example 7 | Polymerization Example 7 (80) | PVA (20) | | 1.32 | ○ |
| Example 8 | Polymerization Example 1 (85) | starch (15) | | 1.32 | ○ |
| Example 9 | Polymerization Example 2 (75) | SBR (15) | calcium carbonate (10) | 1.30 | ○ |
| Example 10 | Polymerization Example 3 (75) | PVA/SBR (15/10) | | 1.33 | ◎ |
| Example 11 | Polymerization Example 5 (70) | starch/AE (10/10) | calcined clay (10) | 1.34 | ◎ |
| Comp. Example 1 | Polymerization Example 1 (50) | PVA (50) | | 0.99 | X |
| Comp. Example 2 | Polymerization Example 8 (80) | PVA (20) | | 1.13 | XX |
| Comp. Example 3 | Polymerization Example 9 (85) | PVA/SBR (10/5) | | 0.97 | X |
| Comp. Example 4 | Polymerization Example 10 (80) | starch (20) | | 1.05 | X |
| Comp. Example 5 | Polymerization Example 3 (40) | SBR (20) | calcium carbonate (40) | 1.00 | X |

PVA: polyvinyl alcohol (#K-117 made by Kuraray Co., Ltd)
Starch: MS-4600 made by Nippon Shokuhin Co., Ltd.
SBR: styrene-butadiene latex (Polylac 755 made by Mitsui Toastu Chemicals Inc.)
AE: acrylic emulsion (Armatex #E-175 made by Mitsui Toastu Chemicals Inc.)
Calcium carbonate: Carbital 90 made by Nippon IPC Co., Ltd.
Calcined clay: SATINTONE No. 5 made by ENGELHARD CO., LTD.

What is claimed is:

1. In a thermosensitive recording material having a thermosensitive recording layer containing a color former and a developer for developing a color when said developer contacts said color former and having an undercoat layer, the improvement wherein said undercoat layer interposed between a substrate layer and said thermosensitive recording layer, which contains 10 to 40 parts of a binder and 60 to 90 parts by weight of crosslinked polymer microparticles, which are produced by polymerization of a mixture of styrene or methyl methacrylate and crosslinkable monomer copolymerizable therewith, or of a mixture of styrene or methyl methacrylate and another vinyl monomer and crosslinkable monomer copolymerizable therewith, having a particle diameter of 0.2 to 5.0 μm and a particle diameter distribution, (Dw/Dn) wherein Dw is the weight average particle diameter and Dn is the number average particle diameter of said microparticles of 2.0 or less.

2. A thermosensitive recording material according to claim 1 wherein said polymer microparticles are a crosslinked polymer of a mixture of styrene or of styrene and another vinyl monomer and a crosslinkable monomer copolymerizable therewith.

3. A thermosensitive recording material according to claim 1 wherein said polymer microparticles are a crosslinked polymer of a mixture of methyl methacrylate or of methyl methacrylate and another vinyl monomer and a crosslinkable monomer copolymerizable therewith.

4. A thermosensitive recording material according to claim 1 wherein said crosslinked polymer microparticles are produced by emulsion polymerization of said monomer mixture.

5. A thermosensitive recording material according to claim 4 wherein 0.5 to 10% by weight based on the weight of said monomer mixture of said crosslinkable monomer is employed.

6. A thermosensitive recording material according to claim 5 wherein said monomer mixture comprises up to 20% by weight or less based on the weight of said vinyl monomer of a functional group-containing monomer.

7. A thermosensitive recording material according to claim 4 wherein said polymer microparticles are produced by polymerizing styrene or a mixture of styrene and another vinyl monomer in the presence of a surface active agent and a polymerization initiator to form an emulsion of polymer seed particles, and then polymerizing said monomer mixture containing a crosslinkable monomer in the presence of said seed particle emulsion.

8. A thermosensitive recording material according to claim 1 wherein said undercoat layer contains an inorganic filler, in an amount of up to 20 parts by weight based on the total weight of said filler, said polymer microparticles and said binder.

9. A thermosensitive recording material according to claim 8 wherein said binder is selected from the group consisting of a styrene-butadiene latex, an acrylic emulsion, an aqueous solution of polyvinyl alcohol, starch or hydroxyethyl cellulose, and mixtures thereof.

10. A thermosensitive recording material according to claim 8 wherein said inorganic filler is calcium carbonate or clay.

11. A thermosensitive recording material according to claim 1 wherein said color former in said thermosensitive recording layer is a basic colorless dye selected from the group consisting of fluoran, triallylmethane and phenothiazine, and said developer comprises a phenolic compound or an aromatic carboxylic acid.

12. A thermosensitive recording material according to claim 1 wherein said undercoat layer and said thermosensitive recording layer have a thickness of 5 to 15 μm and a thickness of 2 to 10 μm, respectively.

* * * * *